United States Patent [19]

Noda

[11] Patent Number: 4,995,255

[45] Date of Patent: Feb. 26, 1991

[54] METHOD OF CHANGING DIES FOR A PRESS MACHINE

[75] Inventor: Shigekazu Noda, Ishikawa, Japan

[73] Assignee: Kabushiki Kaisha Komatsu Seisakusho, Tokyo, Japan

[21] Appl. No.: 365,160

[22] PCT Filed: Oct. 12, 1988

[86] PCT No.: PCT/JP88/01039

§ 371 Date: May 30, 1989

§ 102(e) Date: May 30, 1989

[87] PCT Pub. No.: WO89/03262

PCT Pub. Date: Apr. 20, 1989

[30] Foreign Application Priority Data

Oct. 12, 1987 [JP] Japan ..... 62-254790

[51] Int. Cl.[5] ..... B21D 37/00

[52] U.S. Cl. ..... 72/446; 72/404; 72/465; 100/918

[58] Field of Search ..... 72/446, 448, 405, 404, 72/472, 465; 83/560, 571; 100/918

[56] References Cited

U.S. PATENT DOCUMENTS 2,781,015 2/1957 Dehn et al. .

3,233,441 2/1966 Dunlap .

4,601,422 7/1986 Dumargue et al. ..... 72/448

4,700,624 10/1987 Murphy ..... 72/448

FOREIGN PATENT DOCUMENTS 0215326 9/1988 Japan ..... 72/405

*Primary Examiner*—David Jones

*Attorney, Agent, or Firm*—Varndell Legal Group

[57] ABSTRACT

A method of changing dies for a press machine of the type including two or more slides (3*a*, 4*a*) arranged in a side-by-side relationship of which lower dead point in terms of a crank angle is different from one another, wherein a resilient member (10) is interposed between upper die halves (7*a*, 8*a*) and lower die halves (7*b*, 8*b*) for the respective slides (3*a*, 4*a*) and movement of the respective slides (3*a*, 4*a*) is simultaneously interrupted at a crank angle in the proximity of an intermediate angle between the plural lower dead points so that clamping of upper die halves (7*a*, 8*a*) to and unclamping of the upper die halves (7*a*, 8*a*) from the respective slides are achieved during the interruption of movement of the respective slides, whereby mounting of dies on or dismounting of the same from presses is simultaneously achieved for the respective slides (3*a*, 4*a*).

13 Claims, 9 Drawing Sheets

METHOD OF CHANGING DIES FOR A PRESS MACHINE

TECHNICAL FIELD

The present invention relates to a method of changing dies for a press machine such as a transfer press or the like having two or more slides arranged in a side-by-side relationship of which lower dead point in terms of a crank angle is different from each other.

BACKGROUND ART

As shown in FIG. 10, a hitherto known transfer press employable mainly for deep drawing operations is provided with a link driven type slide b adapted to be driven by a link mechanism on the upstream side as seen in the direction of transference of works (as represented by an arrow mark a) and an eccentric gear driven type slide (hereinafter referred to as an eccentric driven type slide) d adapted to be driven by an eccentric portion on the main shaft via a connecting rod on the downstream side.

With such conventional transfer press, a crank angle representative of the lower dead point of the link driven type slide b for deep drawing operation on the upstream side is deviated from a crank angle representative of the lower dead point of the eccentric driven type slide d by an angle in the range of 10° to 20°. For the reason, when the one slide has reached the lower dead point, the other slide has still a certain amount of gap between the upper die half and the lower die half.

In view of this fact, conventional die changing is achieved for two slides in such a manner that one of the dies is separately unclamped from the corresponding slide at the different time when the latter is lowered to its lower dead point. This leads to drawbacks that a long time is required for die changing and die changing operations are performed at a reduced efficiency.

The present invention has been made with the foregoing background in mind and its object resides in providing a method of changing dies for a press machine of the type including two or more slides of which lower dead point in terms of a crank angle is different from each other which assures that the dies on the slides can simultaneously be exchanged with another ones and a time required for die changing can be reduced substantially.

DISCLOSURE OF INVENTION

To accomplish the above object, the present invention provides a method of changing dies for a press machine of the type including two or more slides of which lower dead point in terms of a crank angle is different from each other, wherein elastic means is interposed between an upper die half and a lower die half for the respective slides and movement of the respective slides is simultaneously interrupted at a crank angle in the proximity of an intermediate angle between the plural lower dead points so that clamping of the upper die half to or unclamping of the same from the respective slides is achieved during the interruption of movement of the respective slides.

According to the present invention, when the respective slides are held immovable, the lower surfaces of the upper die halves come in contact with the upper surfaces of the lower die halves with elastic means interposed therebetween and the respective slides remain at the same height. Thus, when the respective upper die halves are unclamped from the respective slides as long as the aforementioned state is maintained, the upper die halves are placed on the lower die halves via the elastic means without an occurrence of falling-down of the upper die halves on the floor. Similarly, upper die halves on plural slides can simultaneously be unclamped from the latter, e.g., by displacing respective bolsters outside of the press line. Things are the same with a case where the upper die halves are clamped to the respective slides. Namely, when the respective slides reach the vicinity of the intermediate angle, their movement is interrupted so that the upper die halves can simultaneously be clamped to them.

Consequently, according to the present invention, die changing (die unclamping/die clamping) can simultaneously be achieved with the respective slides. This assures that a time required for die changing can substantially be reduced and a transfer press can be operated at an improved efficiency in comparison with the conventional die changing which has been executed separately for respective slides. Further, since there is no need of providing a control circuit required for die changing separately for respective presses, electric circuits can be simplified and they can be produced at an inexpensive cost.

BEST MODE FOR CARRYING OUT THE INVENTION

Now, the present invention will be described in detail hereinafter with reference to the accompanying drawings which illustrate a preferred embodiment thereof.

Figure 1:
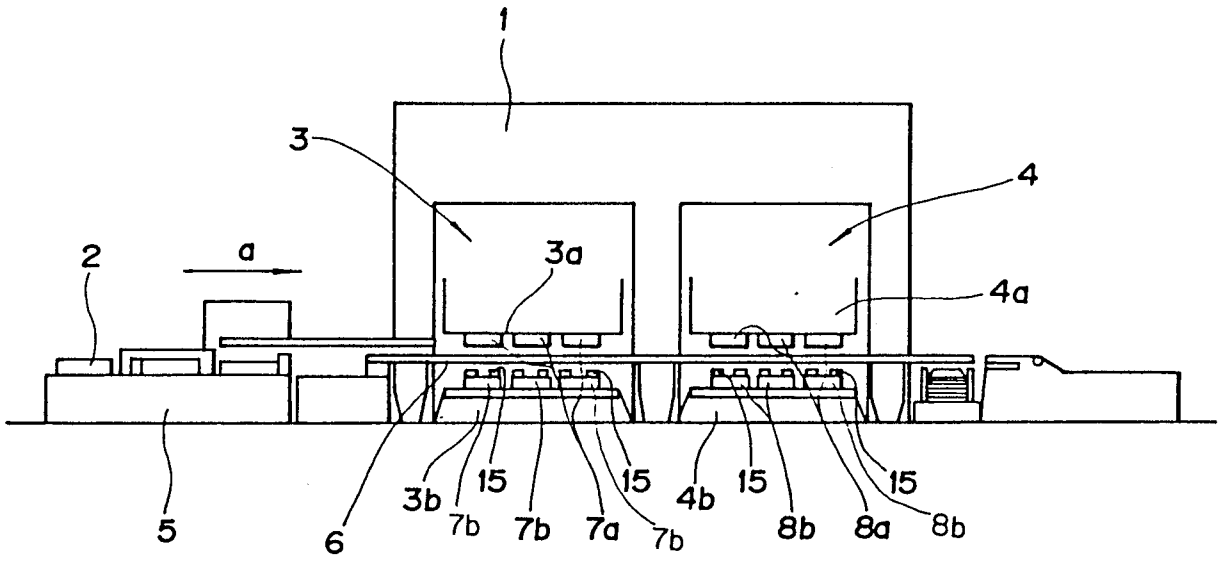
FIG. 1 is a front view illustrating a transfer press for which a method in accordance with an embodiment of the present invention is employed.
Figure 2:
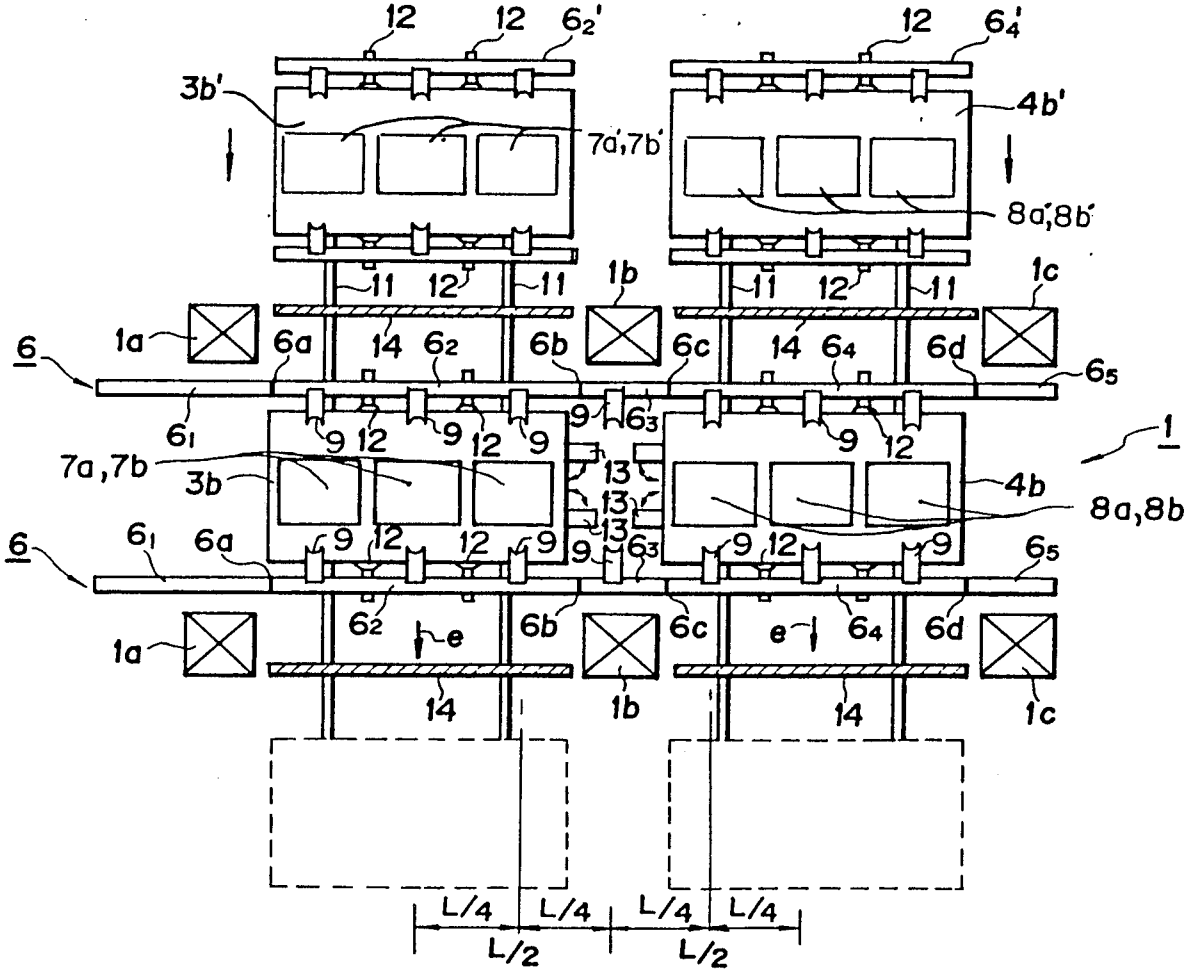
FIG. 2 is a plane view of the transfer press in FIG. 2.

FIG. 1 is a front view illustrating a transfer press for which the method in accordance with an embodiment of the present invention is employed and FIG. 2 is a plan view of the transfer press in FIG. 1.

In FIGS. 1 and 2, reference numeral 1 designate a housing for the three column type transfer press including three sets of uprights 1*a*, 1*b* and 1*c*. The transfer press comprises a link press 3 disposed on the upstream side as seen in the direction a of transference of works (or work pieces) 2 to include a link driven type slide 3*a* and an eccentric press 4 disposed on the downstream side to include an eccentric gear driven type slide 4*a* (hereinafter referred to as an eccentric driven type slide). Both the link driven type slide 3*a* and the eccentric driven type slide 4a are driven by a single main motor (not shown).

Figure 3:
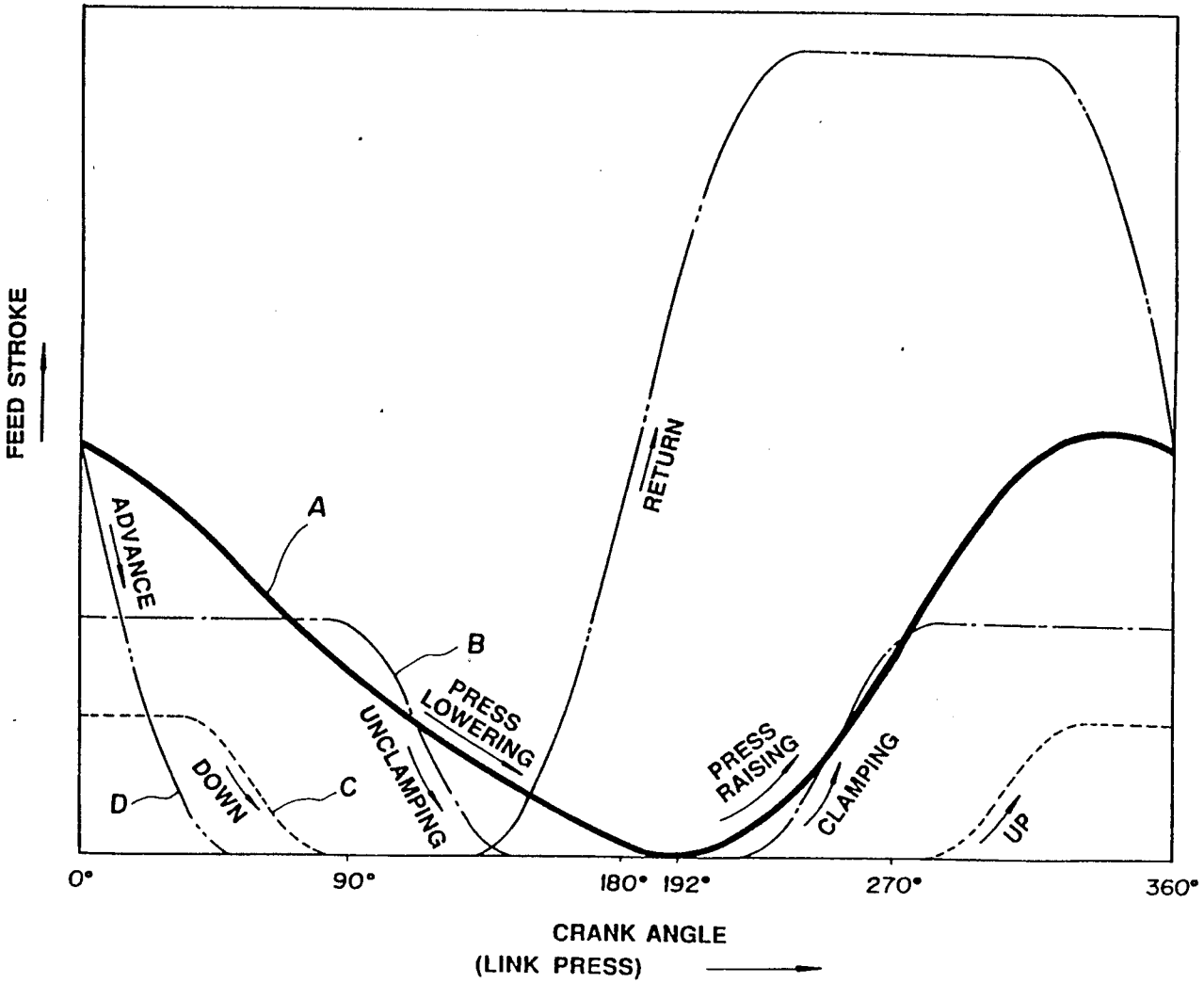
FIG. 3 is a timing diagram for a link driven type slide.

The link press 3 is such that the slide 3a is driven in the vertical direction via a link mechanism so that works 2 are subjected to press forming between three upper die halves 7a clamped to the slide 3a and three lower die halves 7b clamped to a moving bolster 3b. With this link driven type slide 3a, a relationship as represented by a curve A in FIG. 3 is established between a crank angle and a feed stroke. In the illustrated case, the slide 3a has a lower dead point represented by a crank angle of 192°. Usually, the link driven type slide 3a has a crank angle representative of the lower dead point in the range of 190° to 200°. Incidentally, in FIG. 3 curves B, C and D show operations of transfer bars 6.

Figure 4:
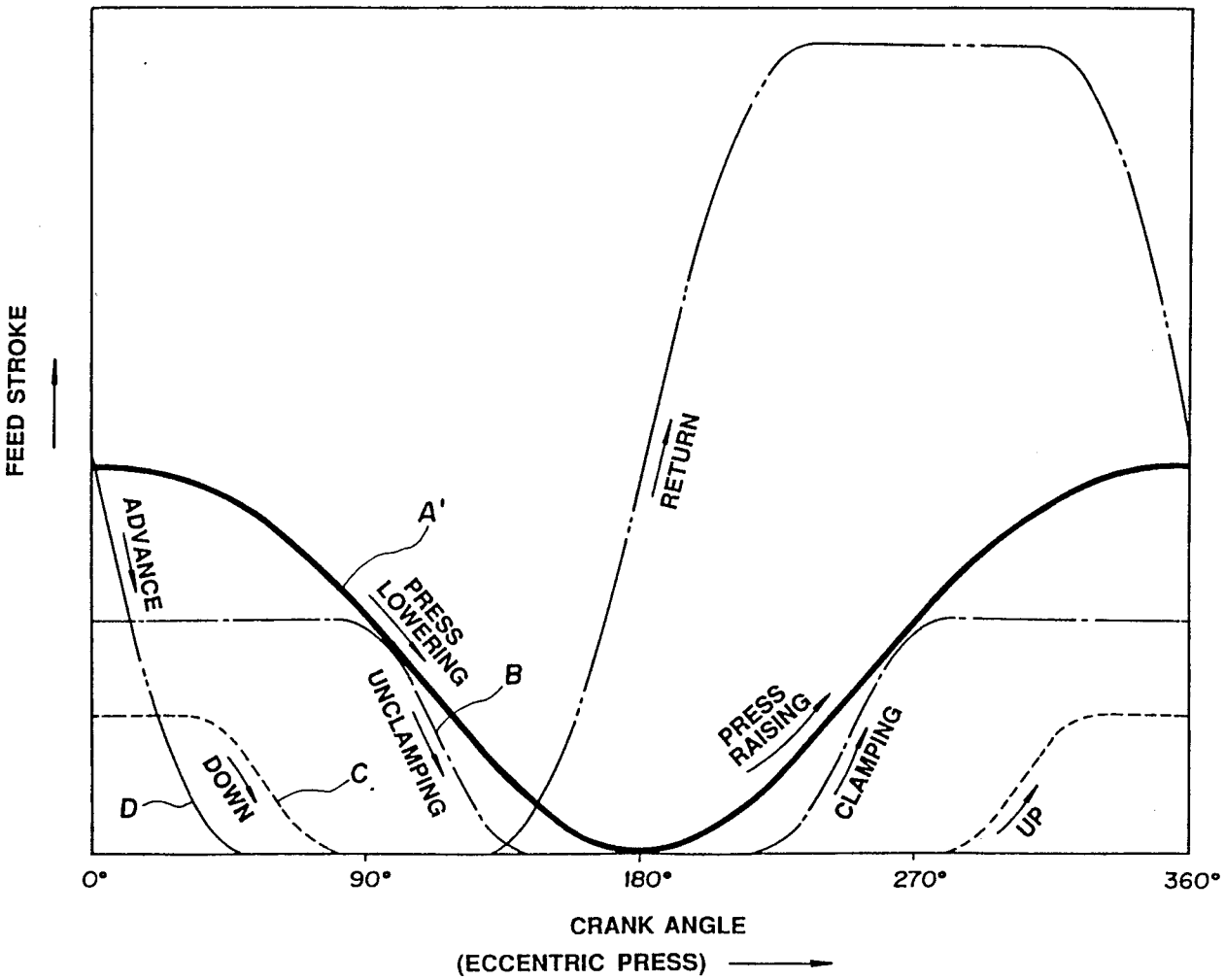
FIG. 4 is a timing diagram for an eccentric driven type slide.

As is well known, the eccentric press 4 is such that the slide 4a is driven in the vertical direction via a slide driving mechanism (not shown) comprising an eccentric portion arranged around the main shaft and a connecting rod so that works 2 are subjected to press forming between three upper die halves 8a clamped to the slide 4a and three lower die halves 8b clamped to a moving bolster 4b. With this eccentric driven type slide 4a, a relationship as represented by a curve A. in FIG. 4 is established between a crank angle and a stroke. This eccentric driven type slide 4a has a lower dead point represented by a crank angle of 180°. Incidentally, in FIG. 4 curves B, C and D likewise show operations of transfer bars 6.

Figure 5:
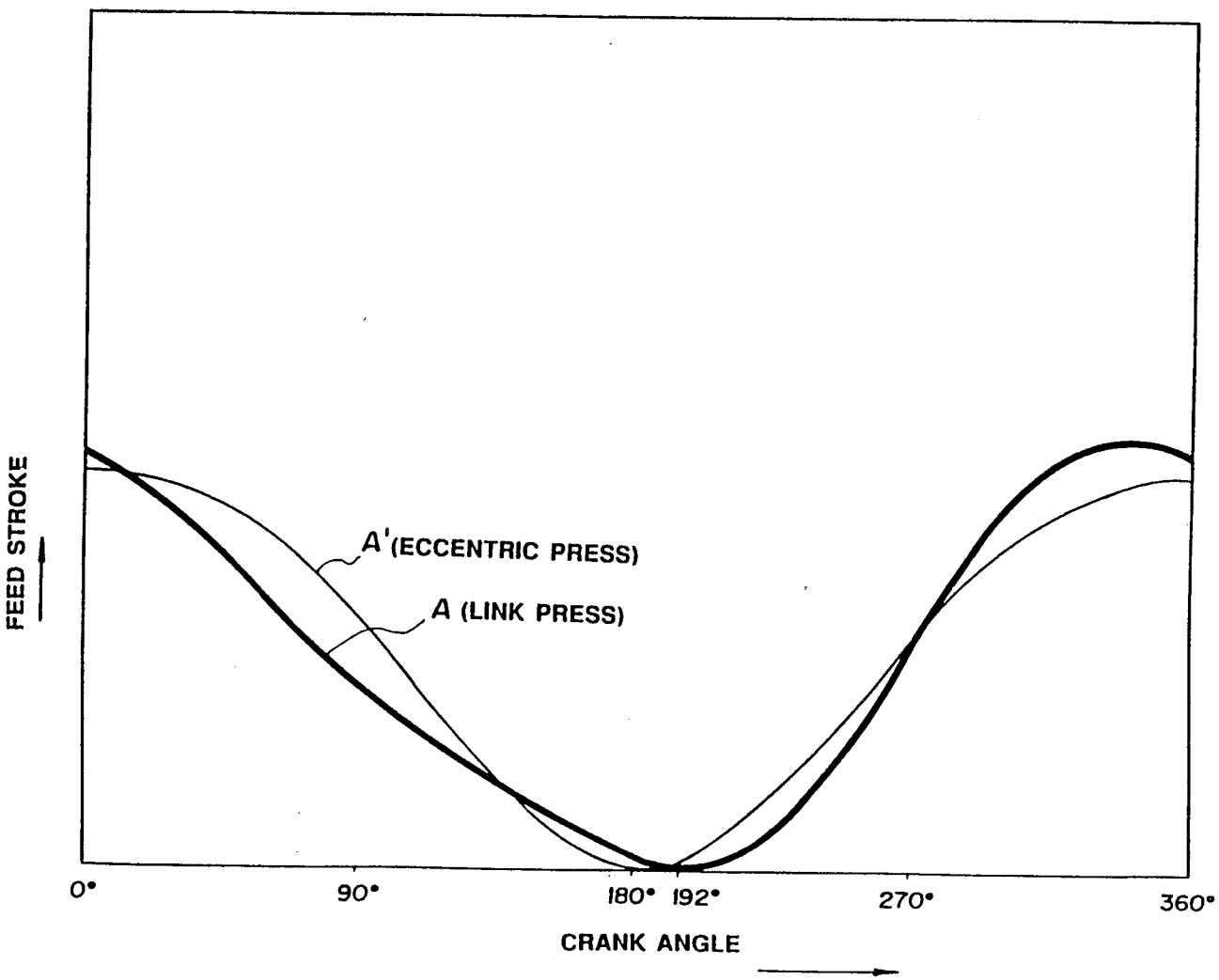
FIG. 5 is a timing diagram for both the link driven type slide and the eccentric driven type slide.

As is apparent from FIG. 5, the transfer press in accordance with this embodiment has a deviation of about 12° between the lower dead point crank angle for the slide 3a of the link press 3 and the lower dead point crank angle for the slide 4a of the eccentric press 4.

Referring to FIGS. 1 and 2 again, works 2 which have been introduced into the housing 1 of the transfer press by a destacker 5 are successively transferred to respective work stations in the eccentric press 4 by the transfer bars 6 adapted to be displaced three-dimensionally. In the illustrated case, each of the transfer bars 6 has five sections $6_1$, $6_2$, $6_3$, $6_4$ and $6_5$ divided by bar connectors 6a, 6b, 6c and 6d on one side. To assure that the works 2 are clamped between both the upper and lower die halves, the respective transfer bars 6 have a plurality of fingers 9 attached thereto.

The moving bolsters 3b and 4b are intended to move on rails 11 in the transverse direction relative to the direction of transference of the works 2 in order to assure that die changing is achieved easily and quickly. In the illustrated case, the transfer press has two moving bolsters for the link press and two bolsters for the eccentric press (i.e., four moving bolsters in total). This is intended to provide such a convenience that with respect to both link press and eccentric press one of the moving bolsters remains in a waiting state with a die and transfer bars to be used for next press work placed thereon while the other one is put in practical use. Each of the four moving bolsters 3b, 3b', 4b and 4b'is provided with a plurality of bar holders 12 on which the transfer bars 6 are placed when they are expanded to their maximum width.

In addition, each of the moving bolsters 3b, 3b', 4b and 4b'is provided with work holders 13 on one side wall thereof so as to provide between the link press 3 and the eccentric press 4 an idle station on which the work is temporarily held. This means that in this transfer press the transfer bars 6 have a feed stroke which is set to $\frac{1}{4}$ of a center distance L between the link press 3 and the eccentric press 4, i.e., L/4. To prevent the work holders 13 constituting an idle station from colliding with the upright 1b during movement of the moving bolster, they are turnable by 90 degrees.

To provide a safety for press operations, a plurality of safety fences 14 are arranged outside of the transfer press in such a manner that they are automatically lifted up when the moving bolsters move.

With such construction of the transfer press, each of the lower die halves 7b and 8b is equipped with four elastic stoppers 15 made of, e.g., polyurethane resin. The elastic stoppers 15 serve not only as shock absorbers between upper and lower die halves during press operation but also as interpositions between upper and lower die halves during die changing.

Figure 6:
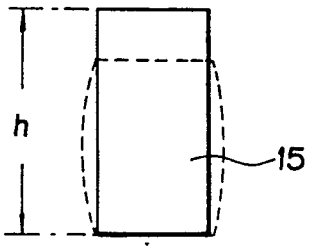
FIG. 6 is an enlarged front view of an elastic stopper usable for the transfer press in accordance with the embodiment of the present invention shown in FIGS. 1 and 2.
Figure 7:
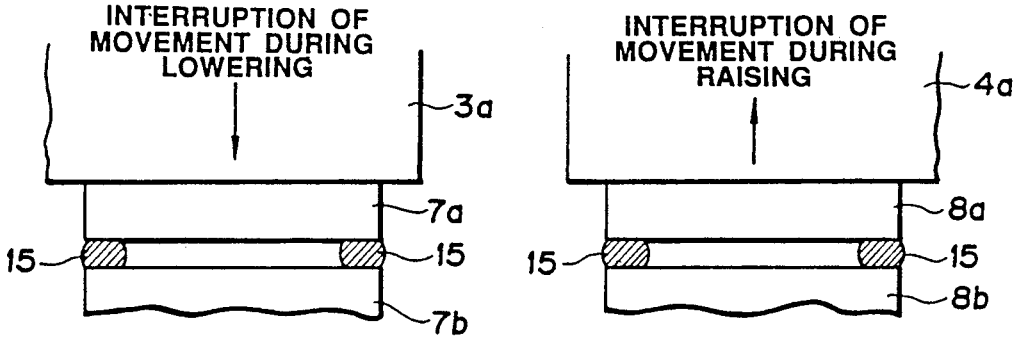
FIG. 7 is a partial view illustrating both presses at the time of clamping/unclamping of dies.

Specifically, the elastic stopper 15 assumes a state as represented by solid lines in FIG. 6 under no load but it has a state as represented by dotted lines in the drawing in the presence of its elasticity when it receives a certain intensity of press force. The transfer press in accordance with the present invention is intended to perform a step of die changing by utilizing the aforementioned nature of the elastic stoppers 15. In detail, while the step of die exchanging is performed, the slides 3a and 4a of the link press 3 and the eccentric press 4 are simultaneously stopped when an intermediate angle between the lower dead point crank angle of the link driven type slide 3a (192° in the illustrated case) and the lower dead point crank angle of the eccentric driven type slide 4a (180° in the illustrated case), i.e., the intermediate angle of 186° in the illustrated case is reached. At this moment, the upper die halves 7a and 8a for both the presses 7a and 8a can simultaneously be unclamped from the slides 3a and 4a. As shown in FIG. 7, when the intermediate angle of 186° is reached, the slide 3a of the link press 3 is moving downwardly toward the lower dead point while the slide 4a of the eccentric press 4 is moving upwardly away from the lower dead point. At this moment, an appreciable amount of gap corresponding to a crank angle of 6° is existent between both the upper and lower die halves of the presses 3 and 4. In practice, the elastic stopper 15 is so designed that the gap is less than the height h of the elastic stopper 15 under no load (see FIG. 6). Thus, there is no fear that the upper die halves 7a and 8a fall down on the floor when they are unclamped from their slides 3a and 4a, as long as the aforementioned state is maintained. Namely, they are immovably held on the lower die halves 7b and 8b via the elastic stoppers 15 interposed therebetween. Then, die changing can simultaneously be achieved for the link press 3 and the eccentric press 4 by raising up the slides 3a and 4a and then exchanging the working bolsters with the waiting bolsters.

Figure 8:
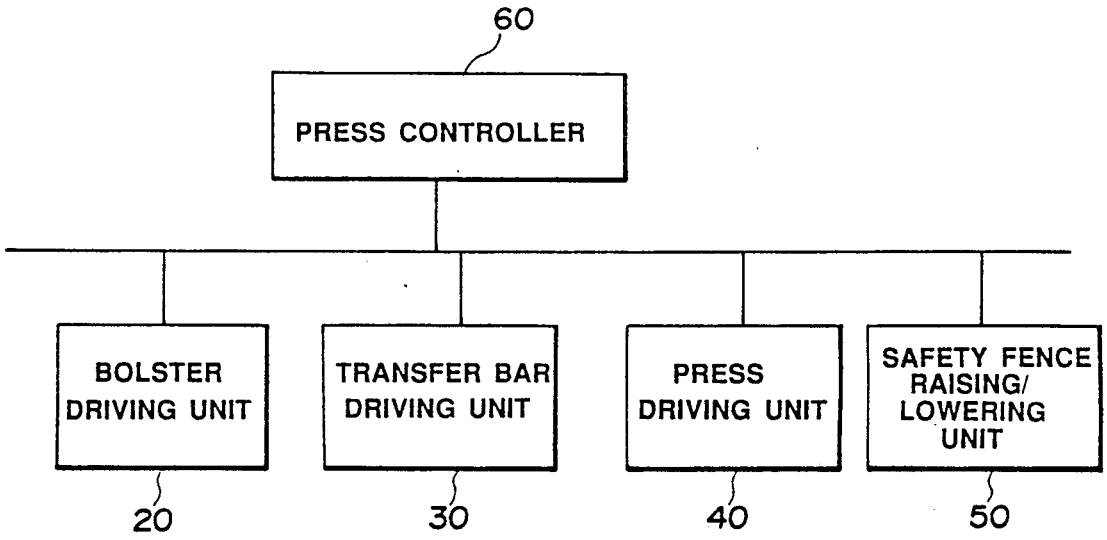
FIG. 8, is a block diagram illustrating by way of example the structure of a control system.

FIG. 8 shows by way of example the structure of a control system for the transfer press. The control system comprises a bolster driving unit 20 for controlling the movement of moving bolsters 3b, 3b', 4b and 4b'and the driving of respective components, a transfer bar driving unit 30 for controlling the three-dimensional movement of transfer bars 6 and the driving of respective components associated therewith, a press driving unit 40 for controlling the raising/lowering of slides of the link press 3 and the eccentric press 4 and the driving of respective components, a safety fence raising/lowering unit 50 for raising and lowering the safety fences 14 and a press controller 60 for executing total control for the aforementioned units.

Figure 9:
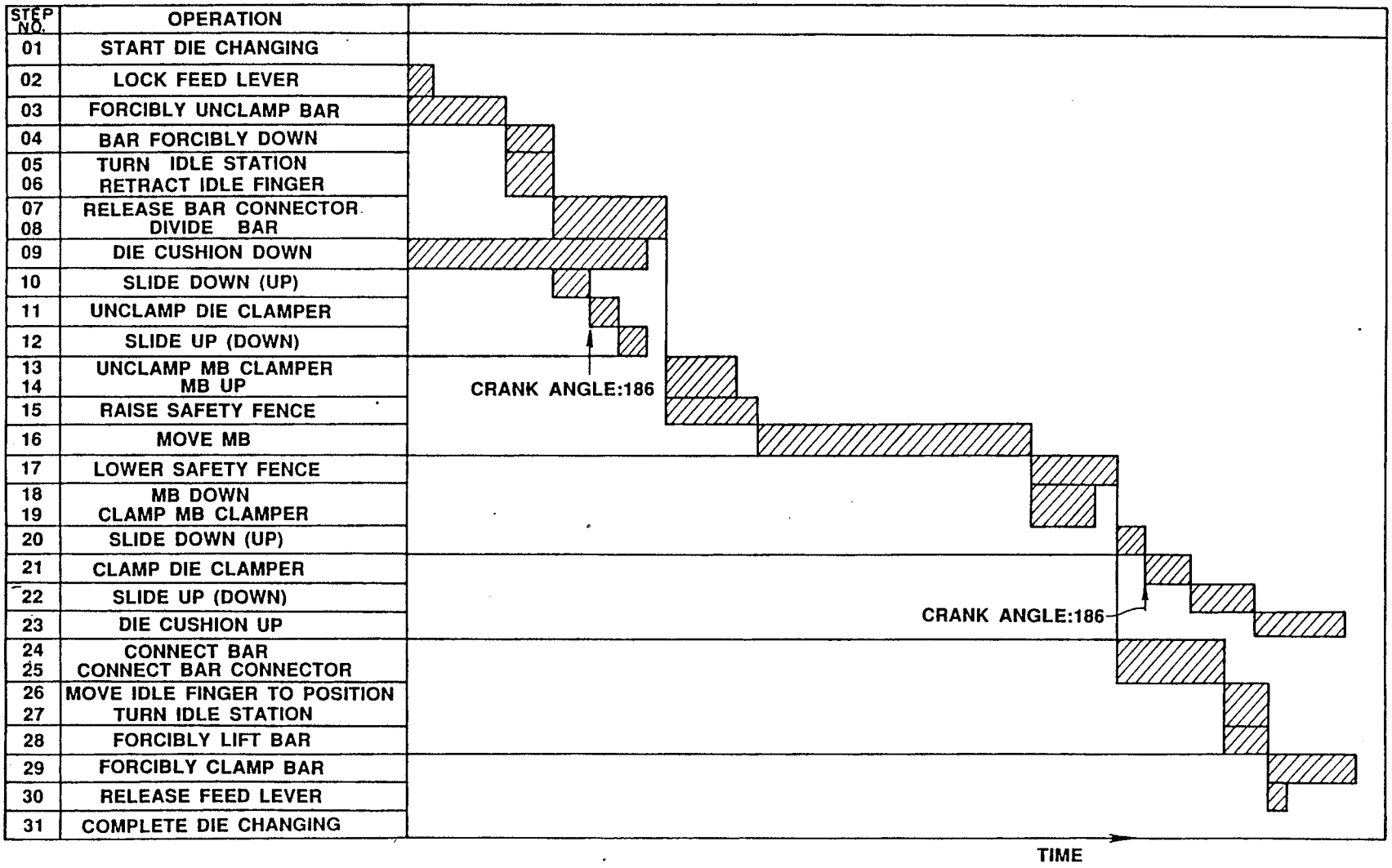
FIG. 9 is a step diagram illustrating a series of steps to be performed at the time of die changing.
Figure 10:
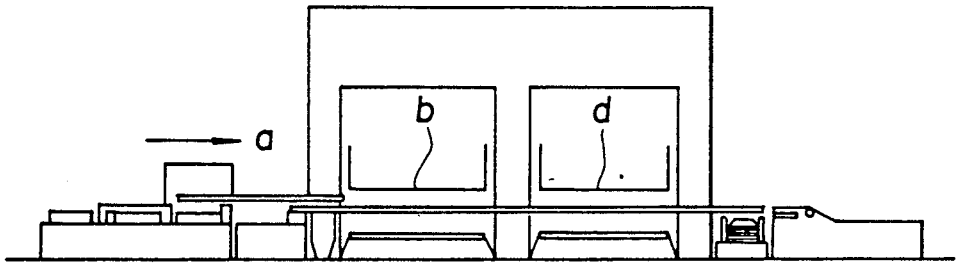
FIG. 10 is a front view illustrating a transfer press for which a conventional method is employed.

Next, operations during the die exchanging as mentioned above will be described in detail below with reference to FIG. 9 which shows a step diagram.

First, a die change button (not shown) is turned on by an operator (step 1). When completion of the step 1 is confirmed, the press controller 60 gives a command the transfer bar driving unit 30 to lock feed levers (not shown) so as not to allow the transfer bars 6 to be displaced in the direction a of transference of works as the crank shaft is rotated (step 2). At this moment, the press controller 60 executes a forcible bar unclamping operation for expanding the width between the transfer bars 6 on both sides to the maximum one (step 3). In addition, at the same time, lowering of the die cushions (not shown) is initiated, whereby the moving bolsters 3*b* and 4*b* are ready to move (step 9).

Next, the press controller 60 gives a command to the bolster driving units 20 and the transfer bar driving unit 30 at the time when step 3 is terminated so that the transfer bars 6 are lowered so as to allow them to be placed on the bar holders 12 attached to the moving bolsters 3*b* and 4*b* while their width is expanded to the maximum one (step 4). At this moment, the work holders 13 attached to the bolsters 3*b* and 4*b* as idle stations are turned by an angle of 90° until the former are received in the latter (step 5). Then, the idle fingers 9 (representative of fingers fitted to the transfer bars $6_3$) adapted to clamp a work on the idle station are displaced to predetermined positions on the bolster 3*b* or 4*b* (step 6). Displacing means (not shown) is provided for the purpose of displacing the idle fingers 9 so that retraction of the idle fingers 9 permits them to be replaced with new ones in correspondence 5 to a die to be next used.

Thereafter, the press controller 60 gives a command to the transfer bar driving units 30 at the time steps 4, 5 and 6 are terminated so that the joint connectors 6*a*, 6*b*, 6*c* and 6*d* for the transfer bars 6 are released so as to allow the transfer bars 6 to be divided into five sections $6_1$ to $6_5$ (steps 7 and 8).

In addition, the press controller 60 gives a command the press driving unit 40 at time steps 7 and 8 are initiated so that the link press 3 and the eccentric press 4 start to lower their slides 3*a* and 4*a* (step 10). At this moment, the slide 3*a* of the link press 3 and the slide 4*a* of the eccentric press 4 perform their lowering movement along curves A and A' in FIG. 5.

As both the slides 3*a* and 4*a* are lowered, first the slide 4*a* of the eccentric press 4 reaches the lower dead point (represented by a crank angle of 180°) and then it starts to be raised up. Thereafter, when the crank angle reaches 186°, the slides 3*a* and 4*a* of both the presses 3 and 4 have the same height, as shown in FIG. 7. Namely, when the crank angle has reached 186°, the slide 3*a* is moving downwardly and the slide 4*a* is moving upwardly.

When the press controller 60 detects that the crank angle has reached 186°, it gives a command the press driving unit 40 so that upward/downward movement of both the slides 3*a* and 4*a* is interrupted and upper die halves 7*a* and 8*a* are simultaneously unclamped from the slides 3*a* and 4*a* (step 11). At this moment, an appreciable amount of gap corresponding to a crank angle of 6° exists between the upper and lower die halves on the presses 3 and 4, as mentioned above. To adapt to the gap, the elastic stoppers 15 are so designed that the gap is less than the height h of the elastic stopper 15 under no load (see FIG. 6). As long as the foregoing state is maintained, there does not arise a malfunction of the upper die halves 7*a* and 8*a* falling down on the floor when they are unclamped from the slides 3*a* and 4*a*. Rather, they are immovably held on the lower die halves 7*b* and 8*b* with the elastic stoppers 15 interposed therebetween.

On completion of the unclamping operations for the upper die halves 7*a* and 8*a*, the press controller 60 restart to drive the slides 3*a* and 4*a*. Namely, the slide 3*a* of the link press 3 is lowered further and it is then raised up after it reaches the lower dead point (representative of a crank angle of 192°). In the meantime, the slide 4*a* of the eccentric press 4 is raised up.

Thereafter, on completion of the dividing operations for the transfer bars 6 at the step 8, the press controller 60 outputs a command to the bolster driving unit 20 so as to allow MB clampers (not shown) with which the moving bolsters 3*b* and 4*b* are fixed to their beds to be unclamped (step 13). Then, the MB clampers are raised up (step 14), whereby the moving bolsters 3*b* and 4*b* are ready to move on the rails 11. At the same time, the press controller 60 gives a command to the safety fence raising/lowering unit 50 so that all the safety fences 14 are raised up (step 17).

Next, the press controller 60 outputs a command to the bolster driving unit 20 so as to allow the moving bolsters 3*b* and 4*b* to move in the direction of arrow marks e in FIG. 2 until they are simultaneously displaced to their waiting positions as represented by dotted lines in FIG. 2. It should be noted that in addition to the upper and lower die halves, the transfer bars 62 and 64 and the idle fingers are mounted on the moving bolsters 3*b* and 4*b*.

On the other hand, other moving bolsters 3*b*'and 4*b*'are previously provided for the presses 3 and 4, and in addition to die halves 7*a*', 7*b*', 8*a*' and 8*b*' to be next used, transfer bars $6_2$' and $6_4$' having fingers 9 attached thereto in correspondence to these die halves and idle fingers are previously mounted on the bolsters 3*b*' and 4*b*'. As the moving bolsters 3*b* and 4*b* are displaced away from their working positions, the moving bolsters 3*b*' and 4*b*' are caused to move into the press housing 1 (step 16).

Thereafter, reverse operations to those in the steps 1 to 15 are performed at steps 17 to 31 so that lowering of the safety fences 14, clamping of the upper die halves 7*a*' and 8*a*' to the slides 3*a* and 4*a* and returning of the transfer bars to their operative state are achieved, whereby the intended die changing is terminated completely.

Incidentally, at the steps 20 to 22 movement of both the slides 3*a* and 4*a* is interrupted when the crank angle reaches an intermediate angle of 186° between the lower dead point crank angles of both the slides 3*a* and 4*a* in the same manner as at the aforementioned steps 10 to 12. At this time, upper die halves 7*a*' and 8*a*' can simultaneously be clamped to both the slides 3*a* and 4*a*.

In this manner, according to the foregoing embodiment, when die changing is executed in a transfer press of the type including a link press 3 and an eccentric press 4 of which slide has a different lower dead point represented by a crank angle from each other, movement of the slides 3*a* and 4*a* of both the presses 3 and 4 is simultaneously interrupted so as to allow upper die halves to be unclamped from the slides and the unclamped upper die halves are elastically supported on elastic stoppers on lower die halves. With the above construction, there does not arise a malfunction the upper die halves falling down on the floor. Instead, they are immovably held on the lower die halves. Thereafter, by displacing moving bolsters away from their working positions, the working dies for both the presses can be removed simultaneously.

Next, die mounting is achieved in the following manner. New dies, each including an upper die half to be next used and a lower die half to be next used while the former is placed on the latter with elastic stoppers interposed therebetween, are clamped to the moving bolsters. Then, movement of the slides 3*a* and 4*a* of both the presses 3 and 4 is simultaneously interrupted at an intermediate angle between the lower dead point crank angles of both the slides in the same manner as mentioned above. While the foregoing state is maintained, upper die halves are clamped to both the slides. In this manner, the new dies for both the presses can simultaneously be mounted on the latter.

Thus, the method of the present invention makes it possible to remarkably reduce a time required for die changing in comparison with the conventional method of die changing. This permits the transfer press to be operated at an improved operational efficiency. Further, since there is no need of arranging a separate control circuit for die changing of the respective presses, the electrical circuits can be simplified and thereby they can be produced at a reduced cost.

It should be noted that the present invention should not be limited only to the foregoing embodiment but various changes or modification may suitably be made with the present invention. In the foregoing embodiment, the crank angle employed at the time of unclamping/clamping of the dies is set to an intermediate angle between the lower dead point crank angles of both the slides. Strictly speaking, the intermediate angle should not necessarily be selected in that way. Alternatively, an angle in the vicinity of the intermediate angle can be employed with the same advantageous effects as in the foregoing embodiment. Namely, the crank angle at the time of unclamping/clamping may be determined in dependence on the height h of the elastic stoppers under no load, their elastic properties and so forth.

The foregoing embodiment has been described above with respect to a transfer press of the type including two slides. Alternatively, the present invention may be applied to a transfer press including three or more slides of which lower dead point in terms of a crank angle is different from each other.

Further, in the foregoing embodiment, the elastic stoppers 15 are fitted to the lower die half. Alternatively, they may be fitted to the upper die half.

Moreover, in the foregoing embodiment, a transfer die feeder is employed as work transferring means. Alternatively, the present invention may be applied to a press machine including a progressive die or the like for which a work is transferred by transferring means other than a transfer feeder.

INDUSTRIAL APPLICABILITY

The present invention is useful for changing dies for a press machine such as a transfer press or the like including two or more slides of which lower dead point in terms of a crank angle is different from each other.

I claim;

1. A method of changing dies in a press machine having a plurality of dies each having an upper die half respectively supported by corresponding slides and a lower die half, said slides arranged with their respective lower dead points different from each other based on a common crank angle, which comprises:

interposing elastic means between said upper die half and said lower die half of said plurality of dies, and interrupting movement of said corresponding slides at a crank angle in proximity of an intermediate angle between said respective lower dead points for clamping of said upper die halves to or unclamping of said upper die halves from their corresponding slides during said interrupting of movement of said corresponding slides.

2. The method as claimed in claim 1, wherein said interposing step includes fitting said elastic means to an upper surface of said lower die half.

3. The method as claimed in claim 1, wherein said interposing step includes fitting said elastic means to a lower surface of said upper die half.

4. The method as claimed in claim 1, wherein said elastic means comprises a plurality of elastic members.

5. The method as claimed in claim 1, wherein said press machine comprises a transfer press including transfer bars for successively transferring a number of work pieces therethrough.

6. A method for changing dies in a press machine having a plurality of first dies each having a first upper die half respectively mounted on corresponding slides and a first lower die half respectively mounted on a corresponding first moving bolsters, said slides arranged with their respective lower dead points different from each other based on a common crank angle, which comprises:

interposing elastic means between said first upper die halves and said first lower die halves of said plurality of first dies, and unclamping said first upper die halves from said slides, repositioning said slides, retracting said first moving bolsters from said press machine to predetermined positions, positioning second moving bolsters within said press machine, said second moving bolsters carrying second dies each having a second lower die half mounted thereon and a second upper die half resting of said second lower die half, positioning said slides at said crank angle in proximity of an intermediate angle between said respective lower dead points, and clamping said second upper die halves to said slides.

7. The method as claimed in claim 6, wherein said interposing step includes fitting said elastic means to an upper surface of first said lower die half.

8. The method as claimed in claim 6, wherein said interposing step includes fitting said elastic means to a lower surface of said first upper die half.

9. The method as claimed in claim 6, wherein said elastic means comprises a plurality of elastic members.

10. A method of changing dies for a press machine having a plurality of first dies each having a first upper die half respectively mounted on corresponding slides and a first lower die half respectively mounted on first moving bolsters, and a plurality of first transfer bars for successively feeding a number of work pieces to said press machine, said slides arranged with their respective lower dead points different from each other based on a common crank angle, which comprises:

interposing elastic means between said first upper die halves and said first lower die halves of said plurality of first dies;

lowering and placing said first transfer bars on said first moving bolsters;

dividing each of said first transfer bars into plural slide units, positioning said slides at a crank angle in proximity of an intermediate angle between said respective lower dead points, unclamping said first upper die halves from said slides, repositioning said slides, retracting said first moving bolsters from said press machine to predetermined positions, introducing second moving bolsters within said press machine, said second moving bolster carrying second dies each having a second lower die half mounted thereon and a second upper die half resting on said second lower die half, repositioning said slides at said crank angle in proximity of an intermediate angle between said respective lower dead points, clamping said second upper die halves to said slides, repositioning said slides, connecting plural divided slide units of second transfer bars to each other on said second moving bolsters, and raising said second transfer bars upwardly away from said second moving bolsters.

11. The method as claimed in claim 10, wherein interposing step includes fitting said elastic means to a upper surface of said first lower die half.

12. The method as claimed in claim 10, wherein interposing step includes fitting said elastic means to a lower surface of said first upper die half.

13. The method as claimed in claim 10, wherein said elastic means comprises a plurality of elastic members.

* * * * *